US007114365B2

(12) United States Patent
Rooney, Jr. et al.

(10) Patent No.: US 7,114,365 B2
(45) **Date of Patent: *Oct. 3, 2006**

(54) RAM GUIDANCE SYSTEM

(75) Inventors: Thomas H. Rooney, Jr., Oaklyn, NJ (US); William D. Jones, Point Pleasant, NJ (US)

(73) Assignee: Humdinger, Inc., Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/225,599

(22) Filed: Sep. 13, 2005

(65) Prior Publication Data

US 2006/0005600 A1 Jan. 12, 2006

Related U.S. Application Data

(63) Continuation of application No. 10/627,047, filed on Jul. 25, 2003, now Pat. No. 6,941,790.

(60) Provisional application No. 60/398,854, filed on Jul. 26, 2002.

(51) Int. Cl.
*B21D 22/00* (2006.01)
*B26D 5/08* (2006.01)
*B21J 13/04* (2006.01)

(52) U.S. Cl. ..... 72/456; 100/214; 100/251

(58) Field of Classification Search ..... 72/455, 72/456; 83/637, 679; 100/214, 245, 251, 100/257, 266, 286, 258 R, 299
See application file for complete search history.

(56) References Cited

U.S. PATENT DOCUMENTS 429,238 A * 6/1890 Heaton ..... 100/214
2,846,278 A * 8/1958 Blazek ..... 83/679
3,357,755 A * 12/1967 Danly ..... 83/637
3,861,192 A * 1/1975 Suzuki et al. ..... 72/456
4,517,879 A * 5/1985 Andersson ..... 100/258 R
4,660,452 A * 4/1987 Leinhaas ..... 100/286
5,109,763 A * 5/1992 Morris et al. ..... 100/266
5,138,862 A * 8/1992 Chasteen et al. ..... 72/456
5,182,988 A * 2/1993 Styfhoorn ..... 100/245
5,669,297 A * 9/1997 Verhoefen ..... 100/257
6,311,597 B1 * 11/2001 Schroth et al. ..... 72/456
6,941,790 B1 * 9/2005 Rooney et al. ..... 72/456

* cited by examiner

*Primary Examiner*—David Jones
(74) *Attorney, Agent, or Firm*—Duane Morris LLP

(57) ABSTRACT

A ram guidance system for a stamping press is provided including an outer bush mounted to a portion of the stamping press. The outer bush has a central passageway sized and arranged so that a reciprocating ram extends through the passageway. An inner bush is coaxially mounted to the outer bush and a portion of the rod, with an anti-friction bearing assembly positioned between the outer bush and the inner bush so as to guide their relative movement. In another embodiment of the invention, a metal stamping system for operating a die set is provided that includes an outer bush mounted to a portion of the stamping press. The outer bush includes a passageway sized and arranged so that a ram extends through the passageway so as to be enclosed by the outer bush. An inner bush is coaxially mounted to (i) the outer bush and (ii) a portion of the ram, with an anti-friction bearing assembly positioned between the outer bush and the inner bush so as to guide their relative movement. Tie rods may be used to form a supporting structure of the press.

29 Claims, 3 Drawing Sheets

RAM GUIDANCE SYSTEM

CROSS-REFERENCE TO RELATED APPLICATION

This application is a continuation application of U.S. application Ser. No. 10/627,047, filed on Jul. 25, 2003, now U.S. Pat. No. 6,941,790 which itself claimed the benefit of U.S. Provisional Patent Application No. 60/398,854, filed Jul. 26, 2002.

FIELD OF THE INVENTION

The present invention generally relates to metal stamping presses and, more particularly, to guidance systems for the force imparting portions of such stamping presses.

BACKGROUND OF THE INVENTION

Progressive metal stamping in which a metal strip or the like is guided along a predetermined path in cadence with the operation of a reciprocating stamping press, is well known in the art. In a conventional technique, one or more flat strips of metal stock are fed into a specially manufactured tool called a "die set" that is located within, and actuated by a stamping press. Metal stamping die sets typically comprise two associated halves, which together are referred to as a "punch and die." A conventional punch and die set has an upper shoe and a lower shoe to which metal forming, cutting, coining, bending, drawing, blanking, notching, embossing, forming, piercing, and punching tools may be mounted. Upon each reciprocating movement or "stroke" of the stamping press, the metal strip is lifted and then advanced by one step through the die set. The tools that are located within the die set move toward and away from the surface of the metal strip during each full cycle of the press. Through the pressure and motion of the die set within the stamping press, the various tools cut out and/or form the metal strip into parts or components of the required size and shape. Metal stamping dies are used to manufacture parts ranging from very small and/or sophisticated components for the electronics industry, to large shapes such as portions of an automotive body. Stamping presses are available in a wide variety of sizes and capabilities, depending upon the size and complexity of the required parts. Stamping presses can produce small parts at very high rates, and may operate at over 3,000 vertical strokes per minute.

The movable part of the stamping press, that is often attached to the upper shoe of the die set, is known as a "ram." The ram moves the upper portion of the die set up and down relative to the lower half of the die set, which is stationary and mounted upon a heavy bolster plate defining a fixed bed. For dependable, correct operation the relative positions, dimensions, and alignment of the two halves of the die set are critical. A lack of sufficient clearance, or unintended contact between portions of the upper and lower die sets can wear or destroy the tools. Thus guidance of the ram during each stroke of the stamping press is a critical factor in accurate and precise die set operation. Conventionally, stamping press rams have utilized four or eight point alignment systems employing either hardened steel plates (gibs) or roller bearing and race elements that are mounted to the corners of the ram, and aligned with the stamping press frame and bed. Such stamping press guidance structures must be heavy and durable if they are to survive a large number of operations. This requirement can make it all the more difficult to ensure accurate and repeatable motion in very heavy driving arrangements needed for durability and longevity. While many stamping presses can operate with ram alignment accuracies in the thousandths of an inch, the tools mounted in their respective die sets must maintain tolerances measured in ten-thousandths, or even millionths of an inch.

As a consequence, there has been a long felt need for a ram guidance system suitable for a wide variety of stamping presses, that provides for greater ram alignment accuracy, approaching the accuracy of the die sets mounted in them.

SUMMARY OF THE INVENTION

The present invention provides a ram guidance system for a stamping press of the type including a reciprocating rod. In one embodiment of the invention, the system comprises an outer bush is mounted to a portion of a stamping press that comprises a central passageway sized and arranged so that the reciprocating rod of the stamping press extends through the passageway. An inner bush is coaxially mounted to the outer bush and a portion of the rod, with an anti-friction bearing assembly positioned between the outer bush and the inner bush so as to guide their relative movement.

In another embodiment of the invention, a metal stamping system for operating a die set is provided that includes a stamping press including a reciprocating ram. An outer bush is mounted to a portion of the stamping press and comprises a passageway sized and arranged so that the ram extends through the passageway so as to be enclosed by the outer bush. An inner bush is coaxially mounted to (i) the outer bush and (ii) a portion of the ram, with an anti-friction bearing assembly positioned between the outer bush and the inner bush so as to guide their relative movement.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
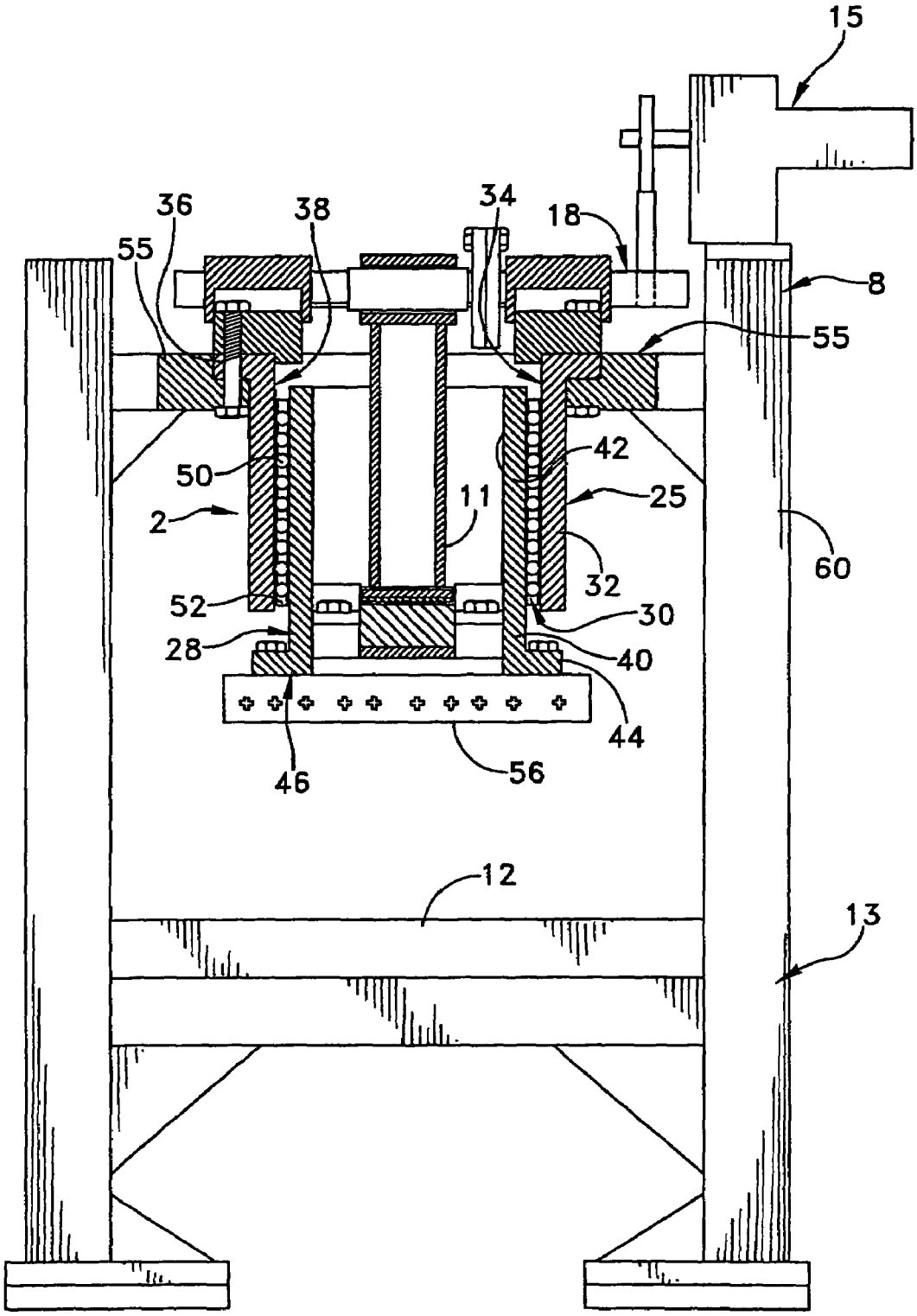
FIG. 1 is a side elevational view, partially in cross-section of a stamping press including a ram guidance system formed in accordance with the present invention.
Figure 2:
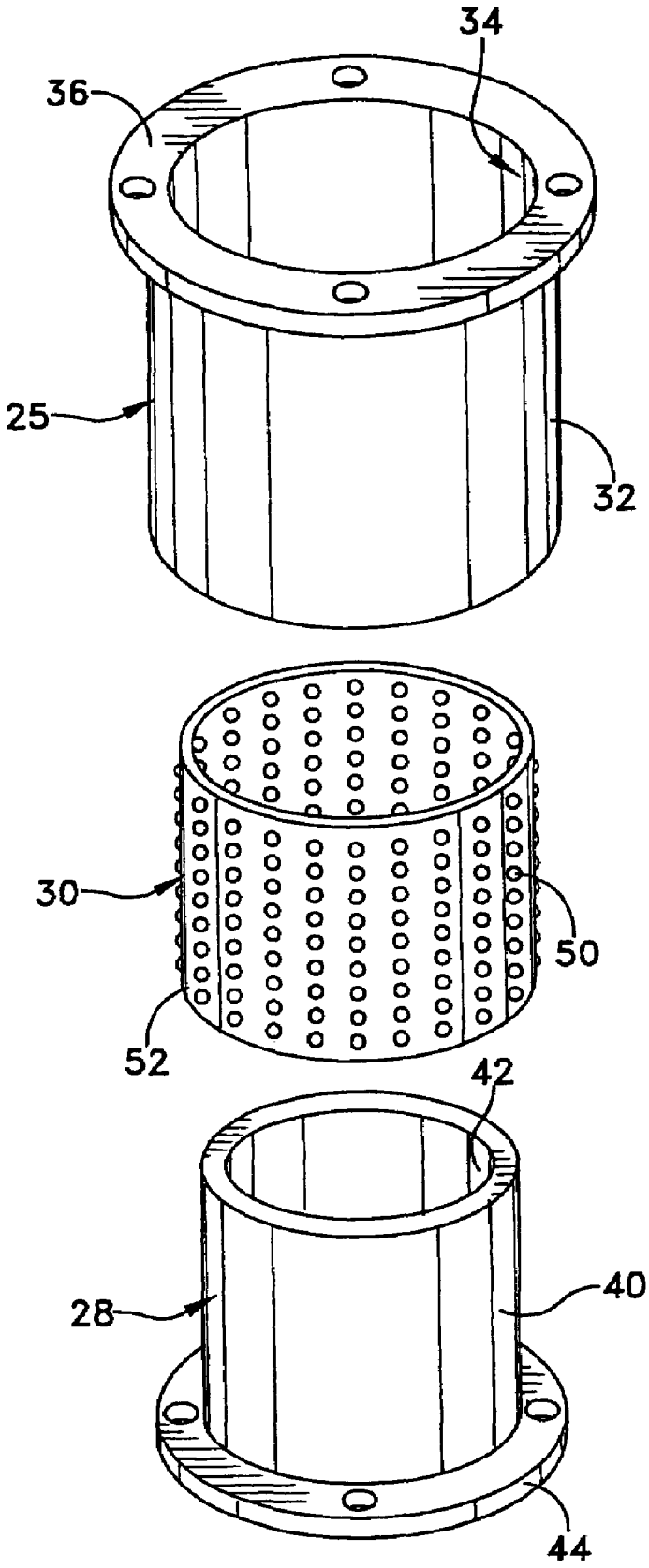
FIG. 2 is an exploded perspective view of the ram guidance system shown in FIG. 1.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Referring to FIG. 1, a ram guidance system 2 formed in accordance with the present invention is often mounted within a stamping and forming press 8 that includes a rod 11 that moves toward and away from a bolster plate 12, that is mounted upon a frame 13. Stamping rates of between approximately 1,000–3000 strokes per minute, or more, are often achieved with such presses, with stroke lengths of about 0.25 inches. An electric motor 15 is also mounted upon frame 13, and coupled to an eccentric drive shaft 18 which drives rod 11. Eccentric drive shaft 18 is often journaled in hydrostatic bearings. A portion of rod 11 is coaxially positioned within ram guidance system 2 which comprises an outer bush 25, an inner bush 28, and an anti-friction bearing assembly 30.

More particularly, outer bush 25 comprises an open ended hollow cylindrical tube 32 having an internal passageway 34, and an annular shoulder 36 that projects radially outwardly from a top end 38. Internal passageway 34 of outer bush 25 includes a hardened surface, and is sized to accept inner bush 28, anti-friction bearing assembly 30, and rod 11. Inner bush 28 also comprises an open ended hollow cylindrical tube 40 having an internal passageway 42, and an annular shoulder 44 that projects radially outwardly from a bottom end 46. The outer surface of inner bush 28 is also hardened, and is sized so as to be accepted within internal passageway 34 of outer bush 25. Anti-friction bearing assembly 30 includes a plurality of circularly and longitudinally spaced ball bearings 50 that are each confined in a bearing cage 52. Bearing cage 52 is often an open-ended, hollow cylinder that is sized so as to encircle inner bush 28, but fit within internal passageway 34 of outer bush 25. The foregoing assembly is very often lubricated with an appropriately selected oil or other lubricant well known in the art.

Ram guidance system 2 is assembled within stamping and forming press 8 in the following manner. Outer bush 25 is positioned within frame 13 so that annular shoulder 36 engages, and is supported by a support plate 55. In this arrangement top end 38 is located adjacent to eccentric drive shaft 18, with rod 11 extending from eccentric drive shaft 18 coaxially through outer bush 25. Anti-friction bearing assembly 30 is assembled to inner bush 28 by orienting bearing cage 52 so as to be in confronting coaxial relation with the top end of inner bush 28. Once in this position, anti-friction bearing assembly 30 is moved toward inner bush 28 so as to accept inner bush 28 within bearing cage 52. In this arrangement, ball bearings 50 are pre-loaded against the outer surface of inner bush 28. Once bearing cage 52 has slid along the outer surface of inner bush 28 until it engages annular shoulder 44, this subassembly is ready to be introduced into internal passageway 34 and outer bush 25. A ram plate 56 is securely, but releaseably, fastened to annular shoulder 44 so as to provide a first surface onto which an upper die shoe may be assembled.

With anti-friction bearing assembly 30 assembled to the outer surface of inner bush 28, the assembly of ram guidance system 2 may be completed by first arranging inner bush 28 and anti-friction bearing assembly 30 in confronting coaxial relation with the bottom end of outer bush 25. Once in this position, inner bush 28 is moved toward outer bush 25 such that rod 11 enters internal passageway 42 and ball bearings 50 engage the hardened surface defining internal passageway 34 of outer bush 25. Rod 11 is then releaseably fastened to an internal portion of ram plate 56 so as to complete the assembly. Ram guidance system 2 is fully supported by frame 13 via support plate 55. In operation, each reciprocating stroke of rod 11 causes inner bush 28 to move vertically, up and down, relative to outer bush 25. Anti-friction bearing assembly 30 via its preloaded condition, acts to guide the relative movement of inner bush 28 relative to outer bush 25.

As a consequence of this construction, the actual forces of punching, forming, etc., are absorbed by the vertical posts 60 connecting support plate 55 with bolster plate 12. In this arrangement, frame 13 will not have to absorb any of the stresses of punching. Moreover, some of the inertial forces, which often cause an imbalance in prior art presses, are isolated and minimized within the present system. Frame 13 provides static support for the press components and drive mechanism, and supplies lateral stability to bolster plate 12 through frame 13.

Figure 3:
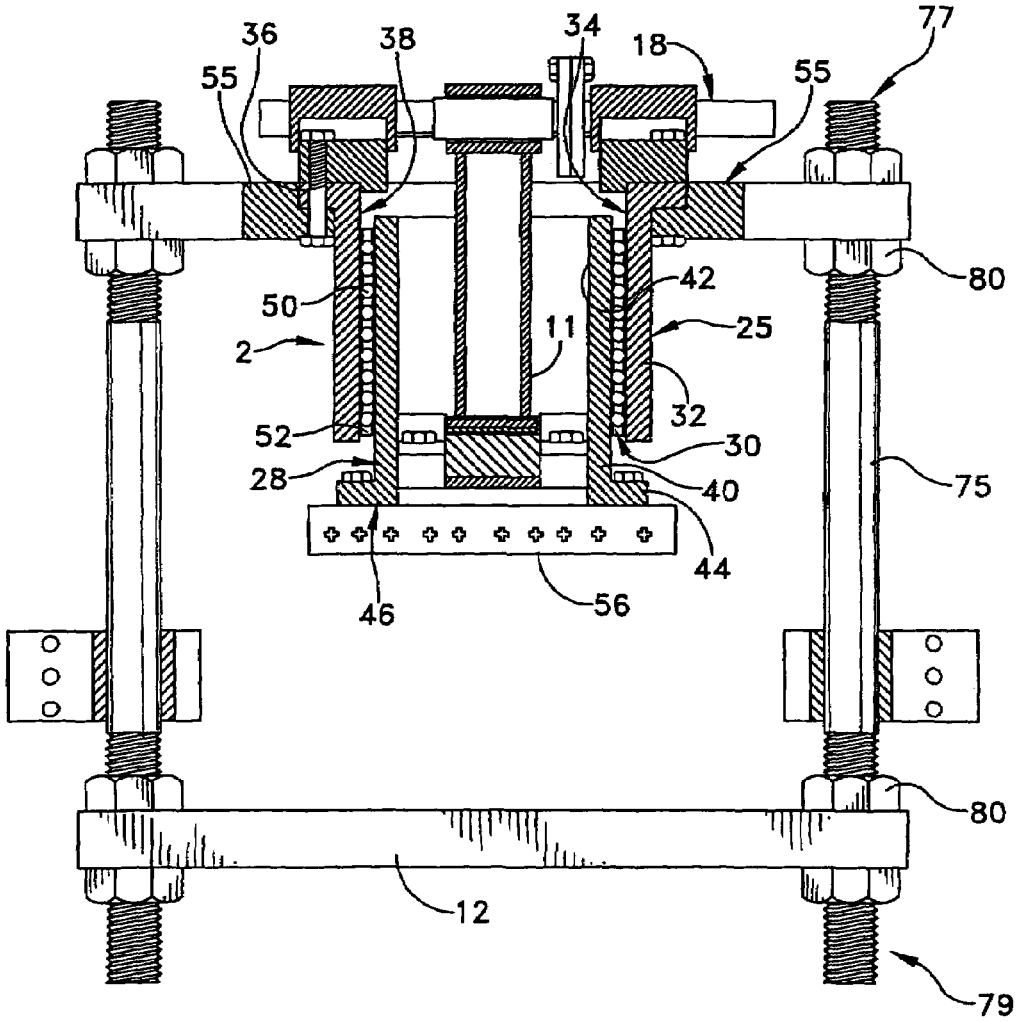
FIG. 3 is a side elevational view, partially in cross-section of an alternative stamping press including a ram guidance system formed in accordance with the present invention.

Ram guidance system 2 allows for a press design in which the frame's sole purpose is to support of bolster plate 12 and to absorb stresses generated from the punching, forming, etc. operations performed upon the metal strip by the die set. Since much of the stress produced by stamping is not born directly on the frame, it may be fabricated from economical structural steel components, rather than custom, heavy cast structures. Also, isolating the stamping portions from the frame minimizes stress deflections caused by the heavy loads of punching, forming, etc., and provides for a lighter and less expensive frame, with emphasis on lateral support. For example, support 55 may be held above bolster plate 12 by a pair of tie rods 75 (FIG. 3). In one embodiment, each tie rod 75 includes a threaded top end 77 and a threaded bottom end 79. Support 55 mounted to top ends 77 and maintained in a selected position by nuts 80. The height of support 55 above bolster plate 12 may be adjusted by movement of nuts 80 along the threads in top ends 77 of tie rods 75. Similarly, bolster plate 12 is mounted to bottom ends 79 and maintained in a selected position by nuts 80. In this embodiment, much of the stress produced by stamping is born by tie rods 75 which distribute those stresses over bolster plate 12. Since there are no large plates or structural coverings, stress induced deflections of the press are minimized, thereby improving alignment and accuracy of the stamping operation.

It is to be understood that the present invention is by no means limited only to the particular constructions herein disclosed and shown in the drawings, but also comprises any modifications or equivalents within the scope of the claims.

What is claimed is:

1. A ram guidance system for a stamping press having a reciprocating rod, said system comprising:

an outer bush mounted to a portion of a stamping press and comprising a central passageway sized and arranged so that a rod of said stamping press extends through said passageway;

an inner bush coaxially mounted to said outer bush and a portion of said rod; and an anti-friction bearing assembly positioned between said outer bush and said inner bush so as to guide their relative movement.

2. A ram guidance system according to claim 1 wherein said outer bush is fixedly mounted upon a frame.

3. A ram guidance system according to claim 1 wherein said outer bush comprises an open ended hollow cylindrical tube having an annular shoulder that projects radially outwardly from a top end.

4. A ram guidance system according to claim 1 wherein said anti-friction bearing assembly includes a plurality of circularly and longitudinally spaced ball bearings that are each confined in a bearing cage.

5. A ram guidance system according to claim 4 wherein said bearing cage is cylindrical and sized so as to encircle said inner bush while fitting within said passageway of said outer bush.

6. A ram guidance system according to claim 5 wherein said ball bearings are pre-loaded against an outer surface of said inner bush.

7. A ram guidance system according to claim 1 comprising a ram plate securely and releaseably fastened to said inner bush.

8. A ram guidance system according to claim 7 wherein said rod is releaseably fastened to an internal portion of said ram.

9. A ram guidance system according to claim 1 wherein said anti-friction bearing assembly via a preloaded condition, acts to guide the reciprocating movement of said inner bush relative to said outer bush.

10. A metal stamping system for operating a die set comprising:

a stamping press including a reciprocating ram;

an outer bush mounted to a portion of said stamping press and comprising a passageway sized and arranged so that said ram extends through said passageway so as to be enclosed by said outer bush;

an inner bush coaxially mounted to (i) said outer bush and (ii) a portion of said ram; and an anti-friction bearing assembly positioned between said outer bush and said inner bush so as to guide their relative movement.

11. A metal stamping system according to claim 10 wherein said outer bush is fixedly mounted upon a frame.

12. A metal stamping system according to claim 10 wherein said outer bush comprises an open ended hollow cylindrical tube having an annular shoulder that projects radially outwardly from a top end.

13. A metal stamping system according to claim 10 wherein said anti-friction bearing assembly includes a plurality of circularly and longitudinally spaced ball bearings that are each confined in a bearing cage.

14. A metal stamping system according to claim 13 wherein said bearing cage is cylindrical and sized so as to encircle said inner bush while fitting within said passageway of said outer bush.

15. A metal stamping system according to claim 14 wherein said ball bearings are pre-loaded against an outer surface of said inner bush.

16. A metal stamping system according to claim 10 comprising a ram plate securely and releaseably fastened to said inner bush.

17. A metal stamping system according to claim 16 wherein said rod is releaseably fastened to an internal portion of said ram.

18. A metal stamping system according to claim 10 wherein said anti-friction bearing assembly via a preloaded condition, acts to guide the reciprocating movement of said inner bush relative to said outer bush.

19. A metal stamping system according to claim 11 wherein forces generated by said reciprocating ram are absorbed by the vertically oriented portions of said frame.

20. A metal stamping system for operating a die set comprising:

a stamping press including a reciprocating ram supported upon a pair of spaced apart tie rods;

an outer bush mounted to a portion of said stamping press located between said tie rods, said outer bush comprising a passageway sized and arranged so that said ram extends through said passageway so as to be enclosed by said outer bush;

an inner bush coaxially mounted to (i) said outer bush and (ii) a portion of said ram; and an anti-friction bearing assembly positioned between said outer bush and said inner bush so as to guide their relative movement.

21. A metal stamping system according to claim 20 wherein said outer bush is fixedly mounted upon a support that is adjustably fastened between said tie rods.

22. A metal stamping system according to claim 20 wherein said outer bush comprises an open ended hollow cylindrical tube having an annular shoulder that projects radially outwardly from a top end.

23. A metal stamping system according to claim 20 wherein said anti-friction bearing assembly includes a plurality of circularly and longitudinally spaced ball bearings that are each confined in a bearing cage.

24. A metal stamping system according to claim 23 wherein said bearing cage is cylindrical and sized so as to encircle said inner bush while fitting within said passageway of said outer bush.

25. A metal stamping system according to claim 23 wherein said ball bearings are pre-loaded against an outer surface of said inner bush.

26. A metal stamping system according to claim 20 comprising a ram plate securely and releaseably fastened to said inner bush.

27. A metal stamping system according to claim 25 wherein said rod is releaseably fastened to an internal portion of said ram.

28. A metal stamping system according to claim 20 wherein said anti-friction bearing assembly via a preloaded condition, acts to guide the reciprocating movement of said inner bush relative to said outer bush.

29. A metal stamping system according to claim 21 wherein forces generated by said reciprocating ram are absorbed and distributed by said pair of tie rods.

* * * * *